US005134793A

United States Patent [19]

Bierwith

[11] Patent Number: 5,134,793

[45] Date of Patent: Aug. 4, 1992

[54] TOOTH MOUNT FOR EXCAVATING BUCKET

[76] Inventor: Robert S. Bierwith, 1331 Eastshore Hwy., Berkeley, Calif. 94710

[21] Appl. No.: 740,276

[22] Filed: Aug. 5, 1991

[51] Int. Cl.[5] ..... E02F 9/28

[52] U.S. Cl. ..... 37/142 A; 37/141 T; 403/374; 403/379

[58] Field of Search ..... 37/141 R, 141 T, 142 R, 37/142 A; 403/374, 379, 409.1

[56] References Cited

U.S. PATENT DOCUMENTS

| | | | |
|---|---|---|---|
| 1,582,095 | 4/1926 | Symes et al. | 403/374 |
| 2,994,141 | 8/1961 | Stephenson | 37/142 R |
| 3,160,967 | 12/1964 | Nichols | 403/374 X |
| 3,572,785 | 3/1971 | Larson | 37/142 A |
| 3,722,932 | 3/1973 | Dougall | 37/142 A X |
| 4,267,653 | 5/1981 | Hahn et al. | 37/142 A |
| 4,271,615 | 6/1981 | Jones | 37/142 A |
| 4,413,432 | 11/1983 | Bieswith | 37/142 A |
| 4,663,867 | 5/1987 | Hahn et al. | 37/142 A |

*Primary Examiner*—Randolph A. Reese
*Assistant Examiner*—Arlen L. Olsen
*Attorney, Agent, or Firm*—Townsend and Townsend

[57] ABSTRACT

A C-clamp and a wedge of an adapter for an excavating bucket have locking parts which substantially eliminate any tendency for the wedge to become loosened from a space between the C-clamp and a wedge block. Spring loaded teeth in the front surface of the C-clamp are received in corresponding notches in the juxtaposed rear surface of the wedge. As the wedge is driven into its operating position, the spring loaded teeth in the front of the C-clamp alternately move into and out of the adjacent notches until the wedge is tight and as the teeth are received in the notches, thus locking the wedge in place. The wedge is removed by driving the wedge block downwardly, shearing a shear pin, thereby allowing the wedge block, the wedge and the C-clamp to be separated from the adapter and fall to the ground.

12 Claims, 3 Drawing Sheets

TOOTH MOUNT FOR EXCAVATING BUCKET

This invention relates to improvements in the mounting of excavating teeth on heavy duty soil excavating buckets and, more particularly, to an improved method and apparatus for connecting and locking an excavating tooth adapter to the lip of an excavating bucket.

BACKGROUND OF THE INVENTION

Excavating teeth for an excavating bucket are well known and have been used for years. Such teeth are coupled by an adapter to the front lip of an excavating bucket. The teeth wear and often become loosened on the adapters. In such a case, the teeth must be replaced to avoid damage to the adapter and to the bucket.

A conventional adapter has a pair of spaced legs defining a space for receiving one portion of the lip of the excavating bucket to which the teeth are to be coupled by the adapter. A wedge extending through openings in the legs of the adapter press inclined surfaces of a C-clamp against the outer cam surfaces on the legs of the adapter to cause the legs to effectively grip the lip adjacent to the adapter. A typical disclosure of this structure is given in U.S. Pat. No. 4,413,432.

Due to vibration, wear or other conditions, the wedge can become loosened and fall out. When the wedge falls out, the C-clamp separates from the adapter. Thus, the adapter may be damaged and the lip may need to be replaced also if it is damaged.

U.S. Pat. No. 4,413,432 discloses a C-clamp and a wedge for use in coupling an adaptor to the lip of an excavating bucket. A second wedge is placed between the first mentioned wedge and the C-clamp and is coupled to the C-clamp by a pin. The abutting faces of the two wedges have locking teeth which fit into recesses to effectively lock the wedges together. Upon loosening of the wedges due to wear, they must be replaced. This requires that the pin of the wedge between the C-clamp and the main wedge be removed from the C-clamp and the wedge be forced out of the system.

A main drawback of this notch structure of this patent resides in the fact that the wedges are difficult to install. It is also difficult to disassemble the wedges for replacement purposes.

Because of these problems, improvements are required to insure that the wedge becomes more positively interconnected with the C-clamp to avoid loosening of the adapter on the bucket lip. The present invention provides a resolution to the problem by providing an improved locking means on the wedge and the C-clamp.

SUMMARY OF THE INVENTION

The present invention includes a C-clamp and a wedge of improved construction in that these two components have cooperating locking parts which work together to prevent vibration and to minimize or substantially eliminate any tendency for the wedge to become loosened from the C-clamp. This avoids a loss and frequent replacement of the wedge and C-clamp and allows for the use of a wedge block forwardly of the wedge and engaging the wedge to urge the wedge toward the C-clamp. A shear pin adjustably couples the wedge block to the lip. The wedge block has several locations for receiving a shear pin, and the location at which the pin is placed depends upon the degree of wear on the lip.

The locking means includes a number of spring loaded teeth in the front surface of the C-clamp, and such teeth engage and are removably received in corresponding notches in the adjacent rear surface of the wedge. As the wedge is driven into its operating position, the spring loaded teeth in the front surface of the C-clamp alternately go into and out of the notches until the wedge is tight. When this occurs, a number of the teeth will have been received in the notches, thus positively locking the wedge in place against the C-clamp. The bucket and teeth coupled with the adapter can then be used in the normal fashion.

It is often necessary to replace the wedge and wedge block before the tooth or the bucket becomes damaged. The wedge is removed by driving the wedge block downwardly, shearing the shear pin carried by the wedge block, thereby allowing the wedge block, the wedge and the C-clamp to be separated from the adapter and fall to the ground. If the adapter is worn, it can be replaced with a new adapter and a new shear pin will be put in the wedge block and be installed as a complete system.

The locking means of the present invention provides improvements over the locking means of U.S. Pat. No. 4,413,432. These improvements over the prior patent art are as follows:

1. It is easier to install the wedge, the C-clamp and the wedge block of the present invention than it is to install the wedge, wedge member, and C-clamp of the U.S. Pat. No. 4,413,432;

2. It is easier and safer to disassemble the wedge, wedge block and C-clamp of the present invention because everything can be done in the top of the assembly by merely exerting downward forces on the wedge block to shear off the shear pin so as to allow the wedge, wedge block, and C-clamp to fall away from the adaptor as a unit; and 3. Adjustments can be made for the wear of the bucket lip by selecting any one of a number of shear pin locations in the wedge block.

The primary object of the present invention is to provide an improved wedge and C-clamp combination for coupling an adapter to the lip of an excavating bucket wherein the wedge and C-clamp have an improved lock which causes these two components to be positively locked together to prevent loss of the entire tooth system and damage to the bucket.

Other objects of this invention will become apparent as the following specification progresses, reference being had to the accompanying drawings for an illustration of the invention.

DETAILED DESCRIPTION OF THE INVENTION

Figure 2:
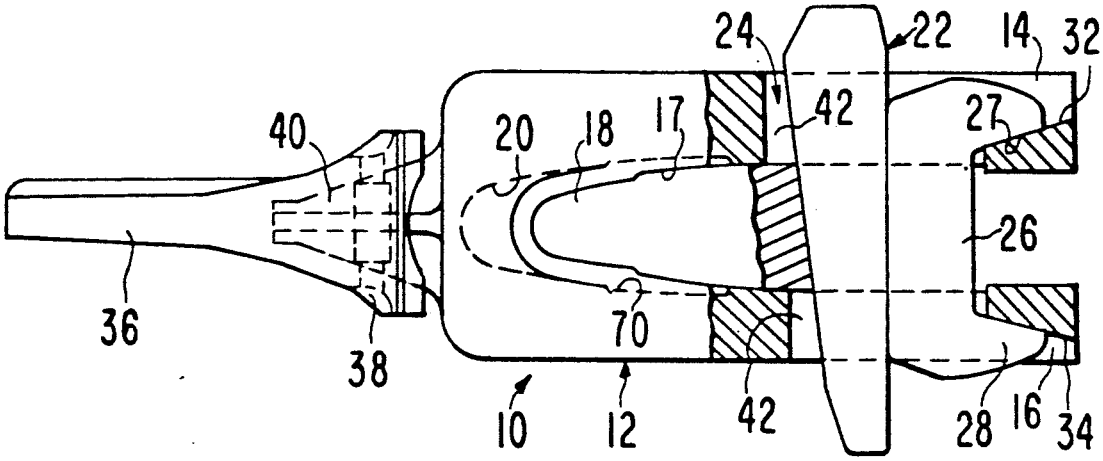
FIG. 2 is a view similar to FIG. 1 but showing a wedge and C-clamp combination of the prior art.

A prior art mounting system for an excavation tooth is shown in FIG. 2 and is broadly denoted by the numeral 10. It includes an adapter 12 having a pair of spaced legs 14 and 16 defining a space 20 therebetween. A lip 18 of an excavation bucket is adapted to be inserted into the space 20 and to extend to the forward end of the adapter.

Adapter 12 is held in place on the lip by a wedge 22 and a C-clamp 26. The wedge 22 engages a surface 23 on lip 18 and forces C-clamp 26 to the right when viewing FIG. 2, C-clamp 26 has inclined inner surfaces 27 on legs 28 which bear against and slide along inclined cam surfaces 32 and 34 on legs 14 and 16 of adapter 12. A tooth 36 is coupled by a retaining pin 38 to the front end 40 of adapter 12. The adapter 12 has a hole 42 therethrough for receiving C-clamp 26 and wedge 22.

Figure 4:
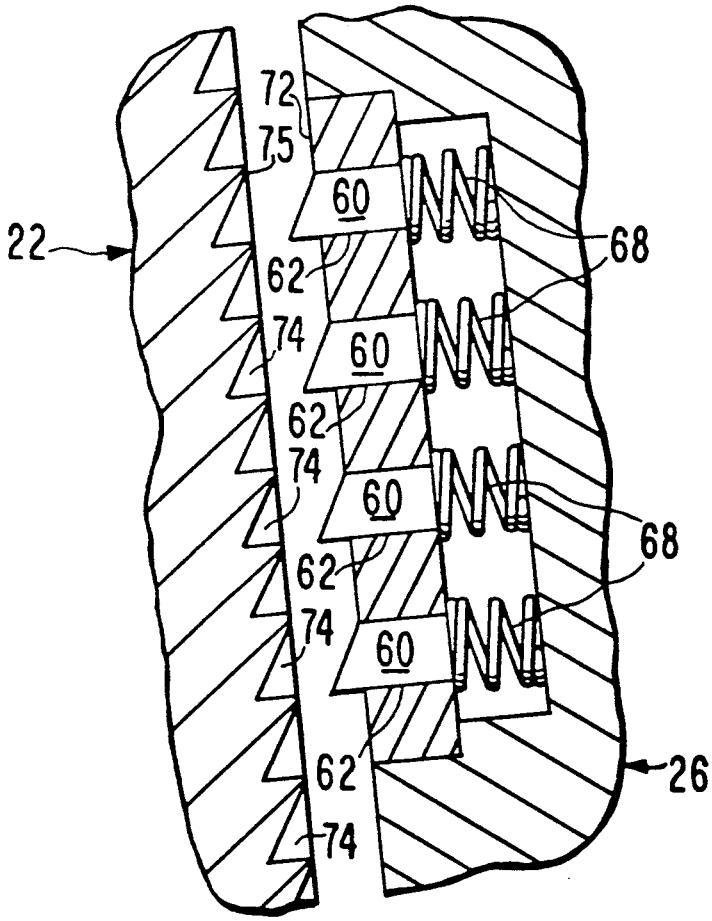
FIG. 4 is an enlarged, fragmentary cross-sectional view of the locking means on the C-clamp in which, before locking the wedge to the C-clamp, the wedge is driven into the space between the C-clamp and the wedge block.

The improvement of the present invention is the provision of a number of teeth 60 (FIG. 4) shiftably mounted in holes 62 in the front face 64 of C-clamp 26. Springs 68 under compression bias the teeth 60 outwardly of surface 64 and the springs are in a compartment 70 such as formed in the C-clamp body. A plate 72 containing the holes 62 mounts the teeth on the C-clamp in uniformly spaced relationship such that the wedge-shaped outer ends of the teeth can be moved successively into notches 74 which are triangular and which are in the adjacent rear face 75 of a wedge 22. Face 75 of wedge 22 converges toward the front face 79 of wedge 22 as the smaller end 81 of the wedge is approached.

Figure 1:
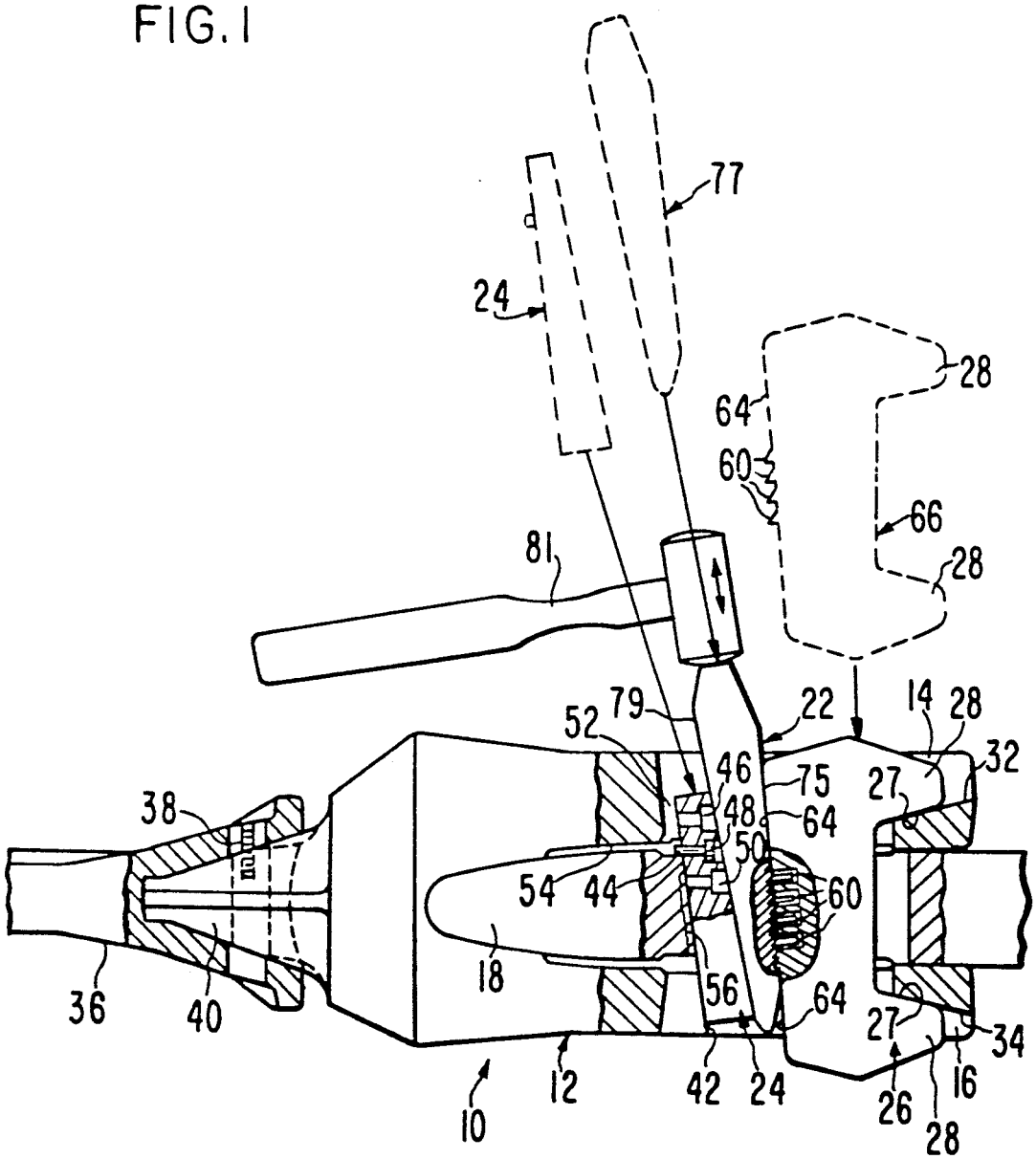
FIG. 1 is a view, partly in section, of the improved tooth mounting system of the present invention, showing the way in which a wedge is positively locked to a C-clamp which couples an adapter to the lip of an excavation bucket.

To assemble the system of FIG. 1, adapter 12 is placed on lip 18 so that the lip extends between the two legs 14 and 16 of the adapter. The forward end of the lip terminates near the front end of the space between legs 14 and 16.

C-clamp 26 is first placed in the opening 42, following which wedge block 24 is placed in hole 42 with the shear pin 44 in one of the bores 46, 48 and 50, as shown in FIG. 1. The wedge block 24 is forced between a surface 31 on lip 18 and a surface 79 of wedge 22. If the front end of the lip is new, the shear pin 44 is typically placed in position 46. If the lip 18 is slightly worn, the pin 44 is placed in bore 48. If the lip 18 is heavily worn, bore 50 is used. The bores communicate with respective spaces in the wedge block 24, such as spaces 52, 54 and 56. Then the wedge 22 is driven by a tool 81 into the space between the front face 64 of C-clamp 66 and the rear face 75 of wedge block 24.

As the wedge 22 is driven into the space, the teeth 60 in a front face 64 of C-clamp 26, successfully move into and out of notches 74 as the notches move past the teeth during the movement of the wedge 22 from top to bottom when viewing FIG. 1. Eventually, wedge 22 will be driven in as far as it will go and will be sufficiently tight so that the adapter is positively locked on the lip 18. There is thus a locking relationship between wedge 22 and C-clamp 26 in which a number of teeth 60 will be received in notches 74. The shapes of the notches and teeth are such that the teeth will permit only downward movement of wedge 22 (when viewing FIG. 1) and will not allow reverse movement of wedge 22. Thus, the wedge 22 cannot be separated from the C-clamp 26 nor separated from frictional engagement with the wedge block 24. The wedge 22 will be positively locked to the C-clamp 26 and the adapter cannot be loosened from the lip 18.

As wear and other conditions cause the wedge 22 to loosen, the wedge cannot fall out. This insures that the system will stay in place, thereby eliminating any possible loss or damage.

Figure 3:
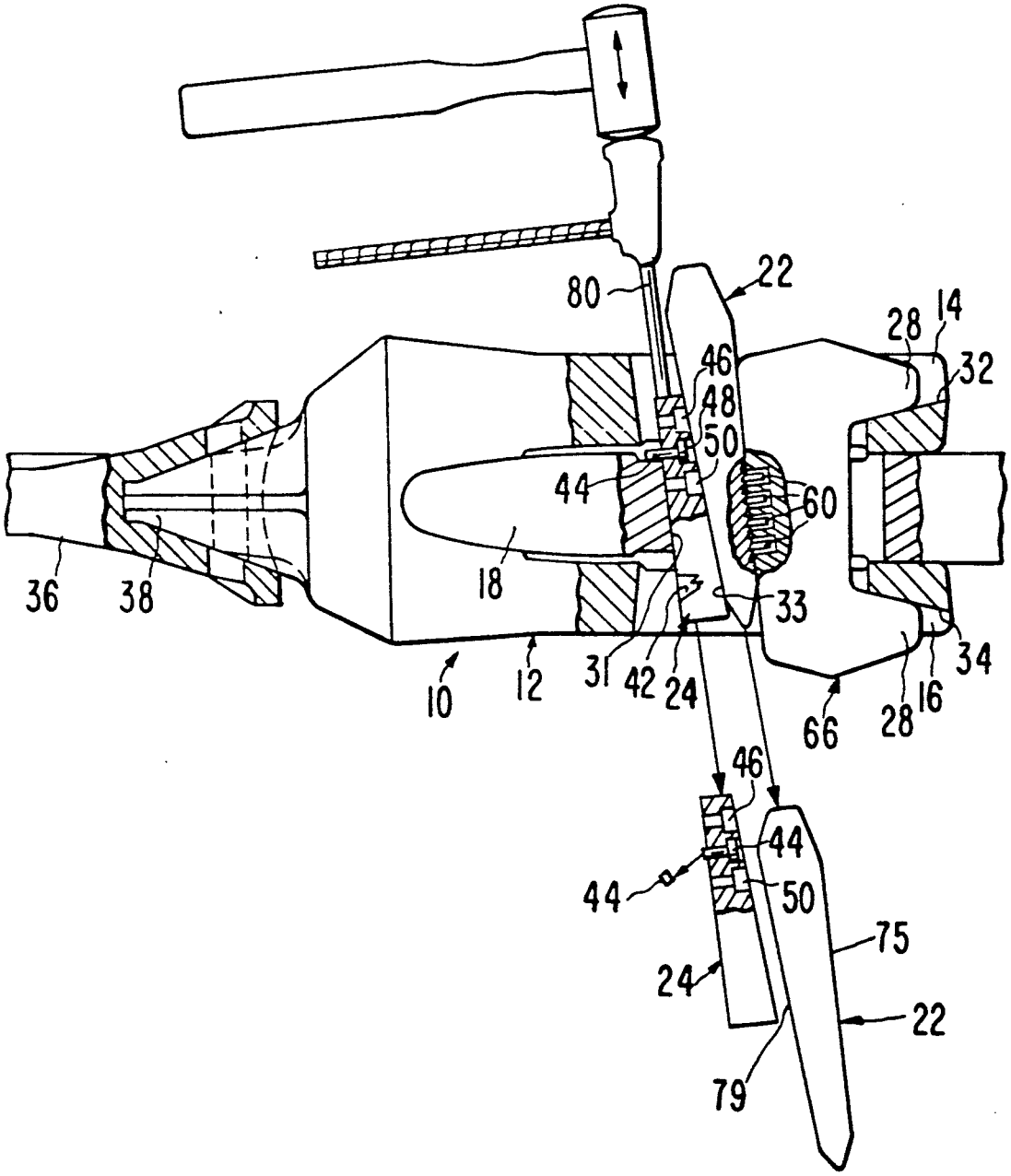
FIG. 3 is a view similar to FIG. 1 but showing the way in which a shear pin holding the wedge block in place can be sheared off to permit replacement of the C-clamp and wedge before structure failure of the tooth mounting system occurs.

Since the clamping system locks all components together, FIG. 3 shows a way of unlocking the parts as needed when the adapter is worn out and needs to be replaced. This is accomplished by driving wedge block 24 downwardly, by a tool 80, shearing the pin 44, to allow the wedge block 24, wedge 22 and C-clamp 26 to fall to the ground. The adapter can then be replaced with a new one. A new shear pin will be placed in the wedge block 24 and the wedge 22 will be reinstalled by forcing it against the wedge block and the C-clamp as described above and shown in FIG. 1.

What is claimed is:

1. In an excavation bucket apparatus having a lip between the spaced legs of an adapter and an excavation tooth pinned to the adapter with the adapter having a hole therethrough for receiving a C-clamp, a wedge block and a wedge between the C-clamp and the wedge block with the wedge and C-clamp having juxtaposed surfaces, the combination with the C-clamp, the wedge and wedge block of:

a lock unit having a pair of parts carried by respective surfaces of the C-clamp and the wedge, said lock parts being operable for releasably locking the wedge to the C-clamp; and shear pin means for coupling the wedge block to the lip.

2. In an excavation bucket as set forth in claim 1, wherein the C-clamp and the wedge present an interface therebetween, one of said locking parts including a projection on one of said clamp and said wedge, the projection extending across the interface, and the other locking part including a recess on the opposite side of the interface means defining for receiving the projection.

3. In an excavation bucket as set forth in claim 2, wherein the projection is spring biased toward said recess.

4. In an excavation bucket as set forth in claim 1, where said lock unit means includes a series of projections on the C-clamp, there being a plurality of recesses on said wedge for removably receiving the projections.

5. In an excavation bucket as set forth in claim 4, wherein the projections are spring biased outwardly of the C-clamp, the projections being wedge-shaped, said recesses being complemental to the wedge-shaped configuration of the projections.

6. In an excavation bucket as set forth in claim 1, wherein the C-clamp has an outer surface provided with a number of aligned teeth shiftably mounted on and projecting outwardly from said juxtaposed surface of the C-clamp, said teeth being spring biased outwardly of the C-clamp, said juxtaposed surface of the wedge having a plurality of recesses therein for shiftably receiving the teeth, each tooth having a surface for engaging a corresponding surface of the wedge to permit movement of the wedge in one direction relative to the C-clamp and for preventing movement of the wedge in the opposite direction relative to the C-clamp.

7. In an excavation bucket as set forth in claim 6, wherein is provided a space in the C-clamp near the juxtaposed surface thereof, there being a plurality of teeth adjacent to the space, means mounting the teeth for movement toward and away from the space, there being means in the space for biasing the teeth outwardly of the space.

8. In an excavation bucket as set forth in claim 6, wherein said wedge has a plurality of aligned recesses therein, each recess being adapted to receive a tooth and being wedge-shaped to prevent reverse movement of the wedge relative to the C-clamp after at least one tooth has been received in a recess.

9. In an excavation bucket as set forth in claim 1, wherein said wedge block has a hole therethrough for receiving a shear pin defining said shear pin means.

10. In an excavation bucket as set forth in claim 9, wherein the wedge block has a number of spaced, parallel holes therethrough for selectively receiving said shear pin.

11. In an excavation bucket having a lip received within the space of an adapter formed by a pair of spaced legs having cam surfaces with the adapter having a hole therethrough and extending transversely of the length of the legs, the combination comprising:

a C-clamp for placement in said hole of the adapter and having a pair of spaced sides for engaging the cam surfaces of the legs of the adapter, said C-clamp having a front surface and a space extending inwardly from the front surface;

a wedge block for placement in said hole;

a plurality of teeth;

means mounting the teeth in the space of the C-clamp for movement inwardly and outwardly therefrom;

means in the space of the C-clamp for biasing the teeth outwardly of the said space, each tooth being wedge-shaped at the outer end thereof;

a wedge having a rear surface adjacent to the front surface of the C-clamp, said rear surface of the wedge having a plurality of aligned recesses therein with each recess being substantially wedge-shaped and complemental to the outer end of a tooth, said teeth being removably received in the adjacent recesses as the wedge is moved in one direction into the hole and between the C-clamp and a wedge block with the teeth being removably received within the recesses and permitting movement of the wedge in one direction but preventing movement of the wedge in the opposite direction; and shear pin means for coupling the wedge block to the lip.

12. In an excavation bucket as set forth in claim 11, wherein the wedge block has bores therethrough for receiving a shear pin defining said shear pin means.

* * * * *